United States Patent [19]

Groelinger

[11] 4,433,028

[45] Feb. 21, 1984

[54] METHOD OF TREATING CELLULOSE DI-ACETATE FIBERS

[75] Inventor: Howard Groelinger, Plainview, N.Y.

[73] Assignee: M.J.H. Converters, Inc., New York, N.Y.

[21] Appl. No.: 455,276

[22] Filed: Jan. 3, 1983

[51] Int. Cl.[3] ..... D02G 3/00; B05D 3/02

[52] U.S. Cl. ..... 428/378; 252/8.9; 427/389.9; 427/393.4; 428/264; 428/265; 428/290; 428/375; 428/393; 428/364; 428/365

[58] Field of Search ..... 427/389.9, 393.4; 252/8.6, 8.9; 428/264, 265, 290, 364, 365, 375, 378, 393

[56] References Cited

U.S. PATENT DOCUMENTS 3,087,905 4/1963 Fluck ..... 427/393.4 X 3,462,296 8/1969 Raynolds et al. ..... 427/393.4 X

*Primary Examiner*—Thurman K. Page

*Attorney, Agent, or Firm*—Salter & Michaelson

[57] ABSTRACT

A method of treating cellulose di-acetate fibers to reduce the shrinkage characteristics thereof. The fibers are first immersed in a treating solution comprising a nonionic fluorocarbon long chain polymer, an organic thermosetting resin, an acid liberating catalyst and a carrier selected from the group consisting of water, a water soluble organic solvent or a mixture of water and water soluble organic solvent. The fibers are then removed from the solution, dried at a temperature below 300° F. to evaporate the water and/or solvent therefrom and cured at a temperatue above 300° F. to effect polymerization of the resin and cross-linkage between the resin and the polymer. Fibers treated by the method exhibit significantly improved shrinkage characteristics without reductions in tear strength, tensile strength or abrasion resistance.

12 Claims, No Drawings

METHOD OF TREATING CELLULOSE DI-ACETATE FIBERS

BACKGROUND AND SUMMARY OF THE INVENTION

The instant invention relates to a method of treating cellulose di-acetate fibers to reduce the shrinkage characteristics thereof.

Cellulose di-acetate fibers and garments made therefrom normally exhibit excessive shrinkage characteristics, particularly when they are subjected to laundering and steam pressing. In this connection, fabrics made of untreated cellulose di-acetate fibers frequently shrink as much as six to seven percent when subjected to steam pressing and as much as eight to nine percent when subjected to laundering. To further complicate matters shrinkage of cellulose di-acetate fibers is generally nonuniform and hence can result in distortion of fabrics and garments made therefrom.

Several processes have heretofore been available for the treatment of cellulosic fibers to achieve improved shrinkage control. Resination of cellulosic fibers using thermosetting resins has proven to be an effective method of controlling shrinkage of viscose cellulosic fibers but has proven to be impractical for controlling shrinkage of cellulose di-acetate fibers. This results from the fact that when thermosetting resins are applied to cellulosic fibers they crystallize when catalized and they also cause crosslinkage between the fibers. Both of these phenomena have weakening effects on cellulosic fibers. Acid catalysts which are used to catalize such resins also tend to have weakening effects on cellulosic fibers. While some of these weakening effects can be tolerated when treating viscose fibers which are naturally relatively strong fibers, they cannot be tolerated when treating cellulose di-acetate fibers which are inherently weak fibers. Further, weakening effects are realized when treating cellulose di-acetate fibers as opposed to other types of cellulose fibers as a result of the fact that the curing temperatures which are necessary in resination methods are normally detrimental to cellulose di-acetate fibers. Because of all of these factors, it has been found that when cellulose di-acetate fibers are treated for shrinkage control using conventional resination techniques they are weakened to the point that they can no longer be effectively used in fabrics or yarns. Hence, the conventional techniques utilized for shrinkage control of other types of cellulosic fibers have been found to be inapplicable to the treatment of cellulose di-acetate fibers. For similar reasons, other conventional fabric treatment techniques, such as those used to effect improved water repellency and/or stain resistance, have proven to be impractical for the treatment of cellulose di-acetate fibers, particularly because of the excessive curing temperatures required by such methods.

The instant invention relates to a method of treating cellulose di-acetate fibers to reduce the shrinkage characteristics thereof without adversely effecting fiber strength. In accordance with the method of the instant invention the cellulose di-acetate fibers are first immersed in a treating solution comprising an organic resin, a nonionic fluorocarbon long chain polymer, an acid liberating catalyst and a carrier which preferably comprises water plus a water soluble organic solvent. The fluorocarbon polymer plus the resin comprise between 2 and 25 weight percent of the treating solution, the ratio by weight of polymer to resin is between one-to-one and four-to-one and the solvent is an organic solvent of the type which can be volatilized at a temperature below 300° F. and of the type which can be mixed with the fluorocarbon and the resin without reacting therewith. The fibers with a quantity of the solution thereon are then removed from the solution and dried at a temperature below 300° F., to drive off substantially all of the water and solvent therefrom leaving only the resin, the fluorocarbon polymer and the catalyst on the fibers. In the final step of the method the fibers with the resin-fluorocarbon-catalyst mixture thereon are cured at a temperature in excess of 300° F. to polymerize the resin and effect cross-linkage thereof with the fluorocarbon polymer. It has been found that cellulose di-acetate fibers treated in this manner exhibit substantially improved shrinkage characteristics without being significantly weakened. Further, cellulose di-acetate fibers treated in this manner exhibit memory characteristics which provide advantages in the use thereof in fabrics.

While solutions comprising water, water soluble organic solvents, organic resins, nonionic fluorocarbon long chain polymers and acid liberating catalysts have heretofore been used in the treatment of other types of synthetic fibers, they have been used primarily to improve the water and oil repellency of such fibers and they have not provided improved shrinkage characteristics. Further, such solutions have had relatively high polymer to resin ratios in order to avoid significant fiber stiffening. Due to the fiber weakening effects which have been realized when cellulose di-acetate fibers have been treated by conventional methods, such solutions have normally been considered to be impractical for use on cellulose di-acetate fibers.

Because of the ineffectiveness of virtually all of the heretofore known shrinkage control and water repellency treatments for cellulose di-acetate fibers, heretofore the concensus has been that the effective treatment of cellulose di-acetate fibers with solutions containing significant quantities of organic resins and/or fluorocarbon polymers was impossible. The method of the instant invention departs from this concensus to achieve effective shrinkage control of cellulose di-acetate fibers through the nonobvious application of a solution comprising a fluorocarbon polymer plus a relatively high concentration of a thermosetting resin. The curing techniques utilized in the method of the instant invention also depart substantially from what would normally be considered to be proper for cellulose di-acetate fibers. Specifically, curing is effected at temperatures in excess of 300° F. which would normally be considered to be detrimental to such fibers. In fact, 300° F. is well above the recommended maximum safe ironing temperature for cellulose di-acetate fibers (the ASTM standard for maximum safe temperatures for cellulose di-acetate fibers is 250° F. to 275° F.). While curing temperatures in excess of 300° F. have been used in the treatment of other types of fibers, they have not been used on cellulose di-acetate fibers for this reason, therefore, it has been unexpectedly found that by the use of what would normally be considered an inappropriate treating solution for cellulose di-acetate fibers, and the use of what would normally be considered as excessive curing temperatures, unexpectedly achieve highly beneficial effects in cellulose di-acetate fibers.

It is, therefore, the primary object of the instant invention to provide an effective method of treating cellulose di-acetate fibers to improve the shrinkage characteristics thereof.

Another object of the instant invention is to provide a process of improving the shrinkage characteristics of cellulose di-acetate fibers without causing weakening of the fibers.

Other objects, features and advantages of the invention shall become apparent as the description thereof proceeds as hereinafter set forth.

DESCRIPTION OF THE INVENTION

In practicing the method of the instant invention, cellulose di-acetate fibers are first immersed in a treating solution comprising an organic thermosetting resin, a nonionic fluorocarbon long chain polymer, an acid liberating catalyst and a carrier selected from the group consisting of water, a water soluble organic solvent and water plus a water soluble organic solvent. Thereafter the fibers are removed from the treating solution and dried at a temperature which is below 300° F. until substantially all of the water and/or solvent on the fibers is driven off or volatilized. Finally, the fibers with the resin-polymer-catalyst mixture thereon are cured at a temperature in excess of 300° F. to polymerize the resin and effect cross-linkage between the resin and the fluorocarbon polymer.

The active ingredients of the treating solution comprise the thermosetting resin, the nonionic fluorocarbon long chain polymer, and the acid liberating catalyst. The concentrations of the components in the solution, are such that the fluorocarbon polymer plus the resin comprise between 2 and 25 weight percent of the solution, and such that the ratio by weight of polymer to resin is between one to one and four to one. While generally all thermosetting resins can be used in the treating solution, it has been found that treating solutions comprising melamine resins, such as melamine formaldehyde resin, produce superior results. In fact, treating solutions comprising melamine resins are generally at least four times as effective at achieving improved shrinkage characteristics as solutions comprising other thermosetting resins. The nonionic fluorocarbon long chain polymer utilized in the treating solution comprises a copolymer of at least 25 weight percent of fluoroalkyl monomer and an alkylvinyl ether having the formula $CH_2$—CH—OR wherein R represents a halogen substituted lower alkyl group. A fluorochemical polymer of this type is commercially available as Milease (ICI Americas Inc. TM) F-14. A variety of acid liberating catalysts, such as lactic acid and magnesium chloride, can be utilized in the treating solution. Generally, only minimal concentrations of the acid liberating catalyst are required to effect the desired polymerization and cross-linkage at the curing temperatures herein specified as is generally known in the polymer chemistry art. Further, it is beneficial to maintain catalyst concentrations at minimal levels to minimize possible weakening effects of the acid from the catalyst on the fibers.

The water and the water soluble organic solvent in the treating solution function as carriers for the thermosetting resin, the fluorocarbon polymer and the catalyst. The solvent comprises a water soluble solvent which can be volatilized at a temperature below 300° F. without leaving behind any significant residue and which can be mixed with the fluorocarbon polymer and with the resin without reacting with either. In the preferred method, the solvent comprises a water soluble alcohol, such as isopropanol, and the water to solvent ratio is approximately 50 to 1. Most other water soluble alcohols also make effective solvents as long as they can be volatilized at temperatures below 300° F., preferably below 250° F., and as long as they do not react with either the polymer, the resin or the catalyst. Alcohols, however, have been found to be generally the most effective solvents since they tend to assist the penetration of the active ingredients in the fibers and tend to prevent foaming of the treating solution.

In the first step of the method of the instant invention the cellulose di-acetate fibers, which may be raw fibers or fibers incorporated in yarns or fabrics, are immersed in the treating solution as hereinabove set forth. The fibers are then removed from the treating solution and squeezed by conventional techniques such as dip-squeeze techniques to remove any excess solution. Solution pick up is, however, preferably maintained within a range of approximately 75% to 80% by weight. After the fibers have been removed from the treating solution, they are dried at a temperature below 300° F. to evaporate substantially all of the water and solvent from the solution on the fibers. In this regard, drying is preferably effected at a temperature which is below 250° F. since drying at higher temperatures tends to cause the resin to migrate towards the surface of the fibers. Drying temperatures between 225° F. and 250° F. have been found to work effectively and are also commercially practical. After substantially all of the water and solvent on the fibers has been evaporated, the fibers with the resin-polymer-catalyst mixture thereon are cured at a temperature between 300° F. and 400° F. In this connection the precise curing time necessary to achieve the desired curing varies inversely with the curing temperature, as is well known in the art. For example, curing at 300° F. has been found to take approximately three minutes whereas curing at 350° F. takes approximately thirty seconds. In any event, curing must be effected for a sufficient duration to achieve the desired polymerization and cross-linkage.

It has been found that fibers treated in accordance with the method of the instant invention exhibit substantially improved shrinkage characteristics as well as improved water repellancy and stain resistance without any significant loss in tensile strength, abrasion resistance or tear strength. Further, fibers treated in accordance with the method exhibit memory characteristics and have a smoother and silkier "touch". These results are in sharp contract to what would ordinarily be expected from the treatment of cellulose di-acetate fibers with an organic resin and/or a fluorocarbon, particularly when applied in accordance with the method of the instant invention wherein curing is effected at temperatures in excess of 200° F. Specifically, when compounds containing significant quantities of resins have been applied to cellulose di-acetate fibers by the heretofore known methods, they have caused substantial weakening of the fibers and have produced harsh, coarse handle characteristics in fabrics. Further, the heating of cellulose di-acetate fibers to temperatures in excess of 300° F. has normally caused substantial fiber damage. Hence, it is seen that by utilizing concentrations and temperatures which are well beyond the ranges normally believed to be acceptable for cellulose di-acetate fibers, the method of the instant invention unexpectedly achieves significant results with regard to shrinkage characteristics. Although the exact reason for this is unknown, the use of the particular treating solution and the method steps herein specified has been found to have extremely beneficial results in this regard.

EXAMPLE

A treating solution comprising 6% by weight of a nonionic fluorocarbon long chain polymer, 3% by weight of a melamine formaldehyde resin, 1% by weight of a 50% solution of magnesium chloride catalyst plus water and isopropanol in the ratio of 49 to 1 was prepared. Several cellulose di-acetate fabrics were immersed in the treating solution, dried at 250° F. and then cured at 350° F. for 30 seconds. The fabrics were then subjected to washing and steam pressing and tested for shrinkage with the following results:

| FABRIC | | UNTREATED CLOTH (% Shrinkage) | | TREATED CLOTH (% Shrinkage) | |
|---|---|---|---|---|---|
| CONSTRUCTION | | WARP | FILLING | WARP | FILLING |
| TEST RESULTS STEAM PRESSING 100% DI-ACETATE FABRICS | | | | | |
| 120/68 | TWILL | 3.4% | 1.5% | .4% | .2% |
| 220/64 | SATIN | 2.1% | 1.6% | .6% | .4% |
| 92/62 | TAFFETA | 3.4% | 2.6% | .4% | .3% |
| TEST RESULTS WASHING 100% DI-ACETATE FABRICS | | | | | |
| 120/68 | TWILL | 5.5% | 6.2% | 4.0% | 3.7% |
| 220/64 | SATIN | 5.4% | 4.0% | 2.9% | 3.0% |
| 92/62 | TAFFETA | 6.0% | 6.4% | 3.4% | 4.0% |

It is seen from the above specific example that the instant invention provides an effective method for improving the shrinkage characteristics of cellulose di-acetate fibers. Further, it has been found that the method of the instant invention is effective in this regard without reducing the tensile strength, the abrasion resistance or the tear strength of such fibers. It has also been found that when cellulose di-acetate fabrics are treated in accordance with the method, the spot and stain resistance thereof is substantially improved and the fabrics are imparted with a smooth and silky "touch". The method is carried out utilizing curing temperatures which would normally be considered to be excessive for acetate fibers and, therefore, damaging. The method is also carried out utilizing what would normally be considered to be excessive concentrations of resins which would make cellulose fibers of all types weak and brittle. In spite of this, the method of the instant invention unexpectedly achieves novel and unobvious results in the treatment of cellulose di-acetate fibers and, therefore, presents a significant advancement in the textile art which has substantial commercial merit.

As this invention may be embodied in several forms without departing from the spirit or essential characteristics thereof, the present embodiment is therefore illustrative and not restrictive, since the scope of the invention is defined by the appended claims rather than by the description preceeding them, and all changes that fall within the metes and bounds of the claims or that form their functional as well as conjointly cooperative equivalents, are therefore intended to be embraced by these claims.

What is claimed is:

1. A method of treating cellulose di-acetate fibers to reduce the shrinkage characteristics thereof comprising:

a. immersing said fibers in a treating solution comprising a carrier, an organic thermosetting resin, a nonionic fluorocarbon long chain polymer and an acid liberating catalyst, wherein the fluorocarbon polymer plus the resin comprise between 2 and 25 weight percent of the solution, wherein the ratio by weight of polymer to resin is between 1:1 and 4:1, wherein the fluorocarbon polymer comprises a copolymer of at least 25 weight percent of a fluoroalkyl monomer and an alkylvinyl ether having the formula $CH_2{=}CH{-}OR$ wherein R represents a halogen substituted lower alkyl group, and wherein the carrier is selected from the group consisting of water, water plus a water soluble organic solvent, and an organic solvent, wherein the organic solvent is of the type which can be volatized at a temperature below 300° F. without leaving a significant residue and of the type which can be mixed with the fluorocarbon and with the resin without reacting therewith;

b. removing said fibers from said treating solution;

c. drying said fibers with the treating solution thereon at a temperature below 300° F. to drive off substantially all of said carrier therefrom; and d. curing said fibers with the resin-polymer-catalyst combination thereon at a temperature in excess of 300° F. to polymerize said resin and effect cross-linkage thereof with said fluorocarbon polymer.

2. In the method of claim 1, said drying step being effected at a temperature between 225° F. and 250° F.

3. In the method of claim 1, said resin comprising a melamine resin.

4. In the method of claim 1, the ratio by weight of said fluorocarbon polymer to said resin being approximately 2:1.

5. In the method of claim 1, said fluorocarbon polymer plus said resin comprising approximately 9% by weight of said solution.

6. In the method of claim 4, said fluorocarbon polymer plus said resin comprising approximately 9% by weight of said solution.

7. In the method of claim 3, the ratio by weight of said fluorocarbon polymer to said resin being approximately 2:1.

8. In the method of claim 7, said fluorocarbon polymer plus said resin comprising approximately 9% by weight of said solution.

9. In the method of claim 1, said carrier comprising water plus said solvent, said solvent comprising an alcohol.

10. In the method of claim 9, the ratio of water to alcohol being approximately 50:1.

11. Acetate fibers treated in accordance with the method of claim 1.

12. Acetate fibers treated in accordance with the method of claim 8.

* * * * *